US008878512B2

(12) United States Patent
Kondo

(10) Patent No.: US 8,878,512 B2
(45) Date of Patent: Nov. 4, 2014

(54) REFERENCE CURRENT OUTPUT DEVICE WITH IMPROVED TEMPERATURE CHARACTERISTICS, AND A CORRESPONDING REFERENCE CURRENT OUTPUT METHOD

(75) Inventor: Mamoru Kondo, Tokyo (JP)

(73) Assignee: Lapis Semiconductor Co., Ltd., Yokohama (JP)

( * ) Notice: Subject to any disclaimer, the term of this patent is extended or adjusted under 35 U.S.C. 154(b) by 389 days.

(21) Appl. No.: 13/309,892

(22) Filed: Dec. 2, 2011

(65) Prior Publication Data

US 2012/0139523 A1 Jun. 7, 2012

(30) Foreign Application Priority Data

Dec. 6, 2010 (JP) ..... 2010-271925

(51) Int. Cl.
*G05F 3/16* (2006.01)
*G05F 3/30* (2006.01)

(52) U.S. Cl.
CPC ..... *G05F 3/30* (2013.01)
USPC ..... 323/315; 323/313; 323/316

(58) Field of Classification Search
USPC ..... 323/312–317
See application file for complete search history.

(56) References Cited

U.S. PATENT DOCUMENTS

| | | | | |
|---|---|---|---|---|
| 7,570,107 | B2 * | 8/2009 | Kim et al. | 327/539 |
| 7,936,204 | B2 * | 5/2011 | Im | 327/512 |
| 8,072,259 | B1 * | 12/2011 | Isik | 327/538 |
| 8,373,496 | B2 * | 2/2013 | Cusinato | 327/513 |
| 2006/0145753 | A1 | 7/2006 | Talbot et al. | |
| 2009/0315532 | A1 * | 12/2009 | Negoi et al. | 323/312 |
| 2011/0121809 | A1 * | 5/2011 | Camacho Galeano et al. | 323/313 |

FOREIGN PATENT DOCUMENTS

| | | | |
|---|---|---|---|
| JP | H06-35559 | A | 2/1994 |
| JP | 2002-318626 | A | 10/2002 |
| JP | 2006-262348 | A | 9/2006 |

* cited by examiner

*Primary Examiner* — Jue Zhang
*Assistant Examiner* — Lakaisha Jackson
(74) *Attorney, Agent, or Firm* — Rabin & Berdo, P.C.

(57) ABSTRACT

A reference current output device and reference current output method that may adjust a reference current while maintaining a temperature gradient. In the reference current output device and reference current output method of the present invention, a reference current is outputted by a reference voltage and current output circuit, a reference voltage outputted from the reference voltage and current output circuit is converted to an adjustment current and outputted by a conversion and output circuit, the adjustment current is superimposed with the reference current and a superimposed current is outputted by a superimposition and output section.

18 Claims, 11 Drawing Sheets

RELATED ART

RELATED ART

REFERENCE CURRENT OUTPUT DEVICE WITH IMPROVED TEMPERATURE CHARACTERISTICS, AND A CORRESPONDING REFERENCE CURRENT OUTPUT METHOD

CROSS-REFERENCE TO RELATED APPLICATION

This application claims priority under 35 USC 119 from Japanese Patent Application No. 2010-271925 filed on Dec. 6, 2010, the disclosure of which is incorporated by reference herein.

BACKGROUND OF THE INVENTION

1. Field of the Invention

The present invention relates to a reference current output device and a reference current output method. The present invention particularly relates to a reference current output device and reference current output method, that generate a reference current that does not change dependent on changes in temperature.

2. Description of the Related Art

Japanese Patent Application Laid-Open (JP-A) No. 2006-262348 discloses a proportional-to-absolute-temperature ("PTAT" hereinafter) current output device that generates and outputs a current that does not change dependent on changes in temperature. The PTAT current output device recited in JP-A No. 2006-262348 generates a current that does not change dependent on changes in temperature, by counteracting a current that has a positive temperature gradient from a band gap circuit with a current that has a negative temperature gradient, and using a p-channel metal oxide semiconductor (MOS) field effect transistor (hereinafter, referred to as PMOS transistor) to output the current as a reference current having a predetermined temperature gradient. In the present specification, the meaning of the term "temperature gradient" is intended to include a rate of change of current value with absolute temperature.

However, characteristics of reference currents obtained by using the PTAT current output device recited in JP-A No. 2006-262348 may vary greatly due to variations in the sizes of transistors mounted in the PTAT current output device. Accordingly, in the PTAT current output device, a use of the circuit configuration as illustrated in FIG. 10 to adjust a characteristic of a reference current, have been investigated. FIG. 10 illustrates an invested structural example of the current output device 100. As illustrated in FIG. 10, the current output device 100 includes a reference voltage generation circuit 102 and a reference current generation circuit 104.

The reference voltage generation circuit 102 includes pnp-type bipolar transistors (hereinafter, referred to simply as bipolar transistors) 106 and 108, PMOS transistors 110 and 112, a resistor 114, an operational amplifier 116 and an output terminal 118. A ratio of the size of the bipolar transistor 106 to the size of the bipolar transistor 108 (a transistor ratio) is set as (size of the bipolar transistor 106):(size of the bipolar transistor 108)=1:N (which is a value greater than 1).

In the reference voltage generation circuit 102 with this configuration, a reference voltage having a predetermined voltage, that does not change dependent on changes in temperature, is outputted from the output terminal 118 by counteracting a voltage having a positive temperature gradient applied to the resistor 114, with a voltage having a negative temperature gradient applied to the bipolar transistor 108.

The reference current generation circuit 104 includes, a portion of the reference voltage generation circuit 102, n (an integer that is at least two) PMOS transistors $\mathbf{120}A_1$ to $\mathbf{120}A_n$ connected in parallel and having different sizes, PMOS transistors $\mathbf{120}B_1$ to $\mathbf{120}B_n$, and an output terminal 122. A current mirror circuit is configured by the portion of the reference voltage generation circuit 102 and the PMOS transistors $\mathbf{120}A_1$ to $\mathbf{120}A_n$. Hereinafter, in the descriptions, when it is not necessary to distinguish between the PMOS transistors $\mathbf{120}A_1$ to $\mathbf{120}A_1$, simply "the PMOS transistors 120A" are referred to, and when it is not necessary to distinguish between the PMOS transistors $\mathbf{120}B_1$ to $\mathbf{120}B_n$, simply "the PMOS transistors 120B" are referred to.

In the reference current generation circuit 104 with the above configuration, a reference current i1(=i2) having a positive temperature gradient from the reference voltage generation circuit 102 is fed out through the output terminal 122 as a reference current i3 by the reference current generation circuit 104. This reference current i3 may be fed out as a current in correspondence with the current mirror ratio, set by selectively using the PMOS transistors $\mathbf{120}A_1$ to $\mathbf{120}A_n$. Namely, the reference current i3, which is the current outputted from the PTAT current output device 100, may be adjusted by switching of the PMOS transistors $\mathbf{120}B_1$ to $\mathbf{120}B_n$. Here, FIG. 11 is a graph illustrating absolute temperature characteristics before and after adjustment of the reference current generated by the current output device 100, wherein the horizontal axis represents the absolute temperature. As can be seen from FIG. 11, the current outputted from the current output device 100 can be aligned at a target characteristic point by the reference current i3 being adjusted by the PMOS transistors 120A, as described above.

However, in the current output device 100, because the PMOS transistors 120A have temperature characteristics (because respective currents outputted from the PMOS transistors $\mathbf{120}A_1$ to $\mathbf{120}A_n$ have different temperature gradients), temperature characteristics of the reference current generation circuit 104 may change when the output current is adjusted. Consequently, when the amount of the reference current i3 changes, the temperature gradient of the reference current i3 outputted from the reference current generation circuit 104 changes, for example, as illustrated in FIG. 11, and therefore, it is difficult to adjust the reference current i3 to have a predetermined temperature gradient. Note that, although an example of a conventional current output device that outputs a current having a positive temperature gradient have been described above, the same applies to a current output device that outputs a current having a negative temperature gradient, and therefore is difficult to adjust the outputted reference current to be a current having a predetermined temperature gradient.

SUMMARY OF THE INVENTION

The present invention provides a reference current output device and reference current output method capable of adjusting the amount of a reference current while maintaining a temperature gradient.

A first aspect of the present invention is a reference current output device including: a reference voltage generation section that generates a reference voltage that does not change dependent on changes in temperature; a reference current output section that outputs a reference current having a predetermined temperature gradient; a conversion and output section that converts the reference voltage to a current and uses a current mirror circuit to output the current as an adjustment current; and a superimposition and output section that superimposes the reference current with the adjustment current, and outputs the superimposed current.

A second aspect of the present invention is a reference current output method including: generating a reference voltage that does not change dependent on changes in temperature; outputting a reference current having a predetermined temperature gradient; converting the reference voltage to a current and, by using a current mirror circuit, outputting the current as an adjustment current; and superimposing and outputting the reference current outputted from the step of outputting a reference current with the adjustment current outputted from the step of converting.

According to the above-described aspects of the present invention, the amount of a reference current may be adjusted while maintaining a temperature gradient.

BRIEF DESCRIPTION OF THE DRAWINGS

Exemplary embodiments of the present invention will be described in detail based on the following figures, wherein.

DETAILED DESCRIPTION OF THE INVENTION

Herebelow, exemplary embodiments for carrying out the present invention are described in detail.

Figure 1:
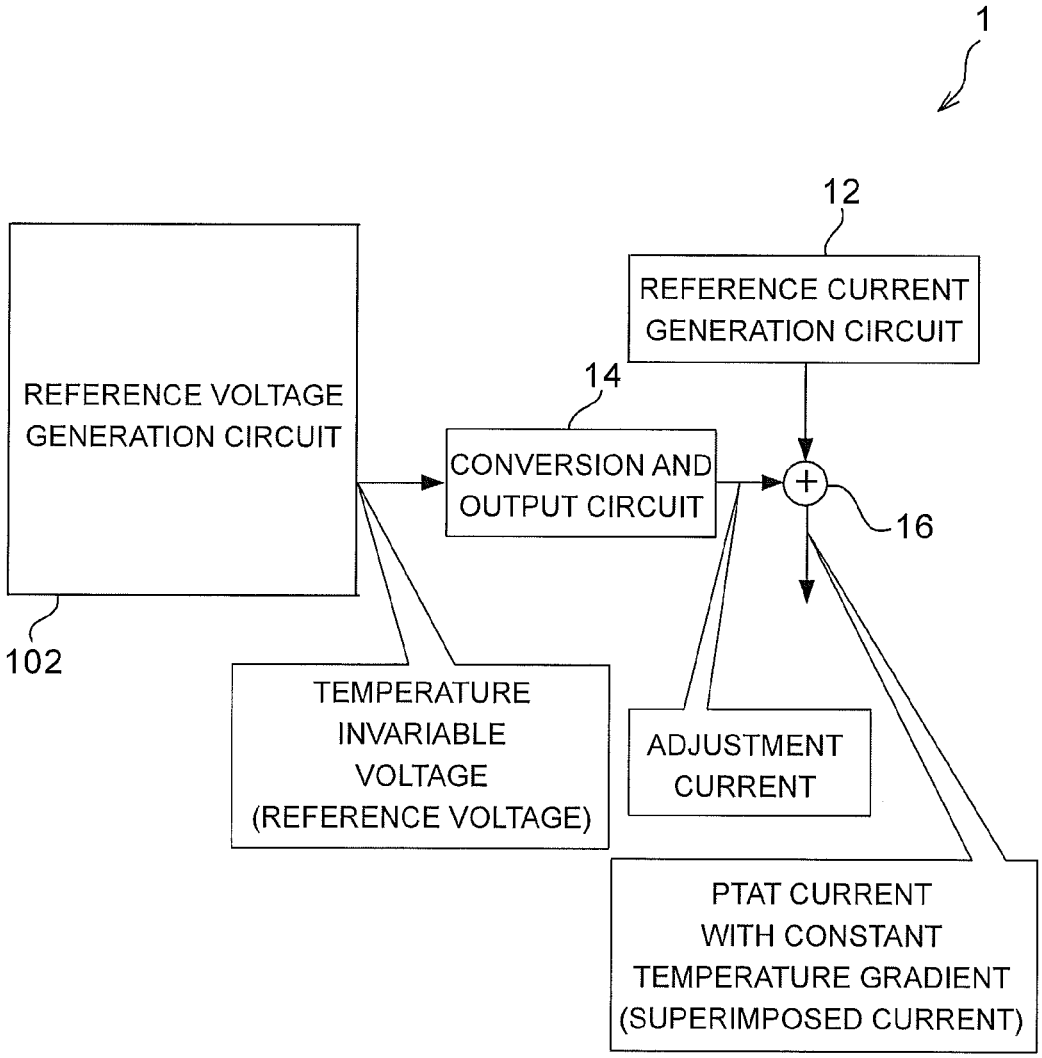
FIG. 1 is a block diagram illustrating a substantial configuration of a PTAT current output device according to the exemplary embodiments.

FIG. 1 shows configurations that are common to a current output device 1 according to the present invention. The current output device 1 illustrated in FIG. 2 includes the reference voltage generation circuit 102, a reference current generation circuit 12, a conversion and output circuit 14, and a superimposition and output section 16.

The reference voltage generation circuit 102 generates a reference voltage that does not change dependent on changes in temperature.

The reference current generation circuit 12 outputs a reference current having a predetermined temperature gradient.

The conversion and output circuit 14 converts the reference voltage generated by the reference voltage generation circuit 102 to a current and, using a current mirror circuit, outputs the current to serve as an adjustment current.

The superimposition and output section 16 superimposes the adjustment current outputted from the conversion and output circuit 14 with the reference current outputted from the reference current generation circuit 12, and outputs the superimposed current.

Herebelow, on the basis of the configurations common to the current output device 1 according to the present invention illustrated in FIG. 1, examples in which a current having a positive temperature gradient is to be outputted and a specific example in which a current having a negative temperature gradient is to be outputted, are described in detail.

First Exemplary Embodiment

Figure 2:
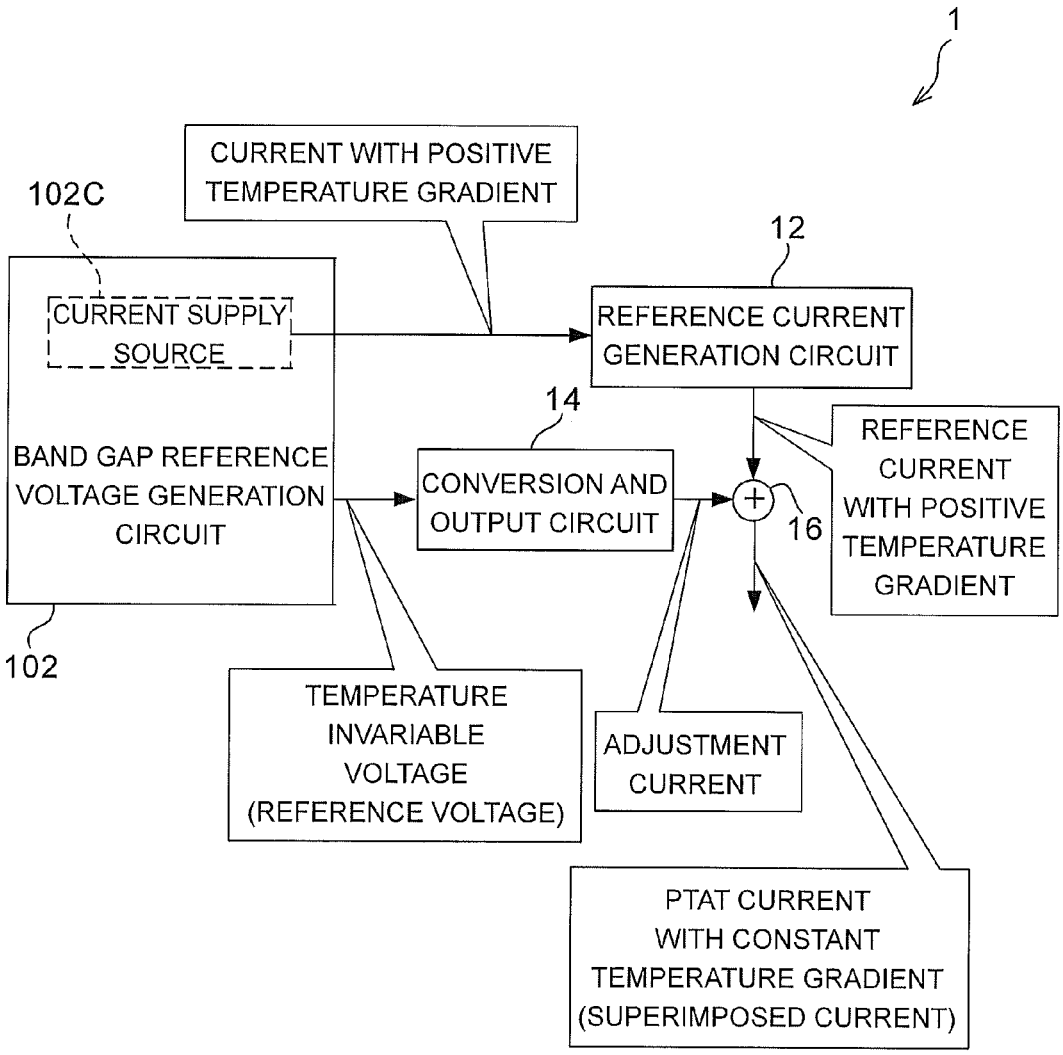
FIG. 2 is a block diagram illustrating a substantial configuration of a PTAT current output device according to a first exemplary embodiment.

FIG. 2 is a block diagram illustrating a substantial configuration of the current output device 1 according to a first exemplary embodiment of the present invention. The current output device 1 includes the reference voltage generation circuit 102, the reference current generation circuit 12, the conversion and output circuit 14, and the superimposition and output section 16. The current output device 1 is a circuit configuration that outputs a PTAT current.

The reference voltage generation circuit 102 is connected to both of the reference current generation circuit 12 and the conversion and output circuit 14. The reference current generation circuit 12 and the superimposition and output section 16 are both connected to the conversion and output circuit 14.

The reference voltage generation circuit 102 is, for example, a circuit that generates a band gap voltage. The reference voltage generation circuit 102 generates a reference voltage that does not change dependent on temperature by counteracting a current that has a positive temperature gradient with a current that has a negative temperature gradient. The reference voltage generation circuit 102 includes a current supply source 102C that supplies the current having a positive constant temperature gradient that is used for generating the reference voltage to the reference current generation circuit 12.

The reference current generation circuit 12 converts the current having the positive constant temperature gradient that is supplied from the current supply source 102C to a reference current having a positive temperature gradient, and outputs the reference current.

The conversion and output circuit 14 converts the reference voltage that does not change dependent on changes in temperature, which is generated by the reference current generation circuit 12, to a current and, using a current mirror circuit (a second current mirror circuit), outputs the current obtained by the conversion to serve as an adjustment current.

The superimposition and output section 16 superimposes the adjustment current outputted from the conversion and output circuit 14 with the reference current outputted from the reference current generation circuit 12, and outputs the current obtained by the superimposition (a PTAT current).

Figure 3:
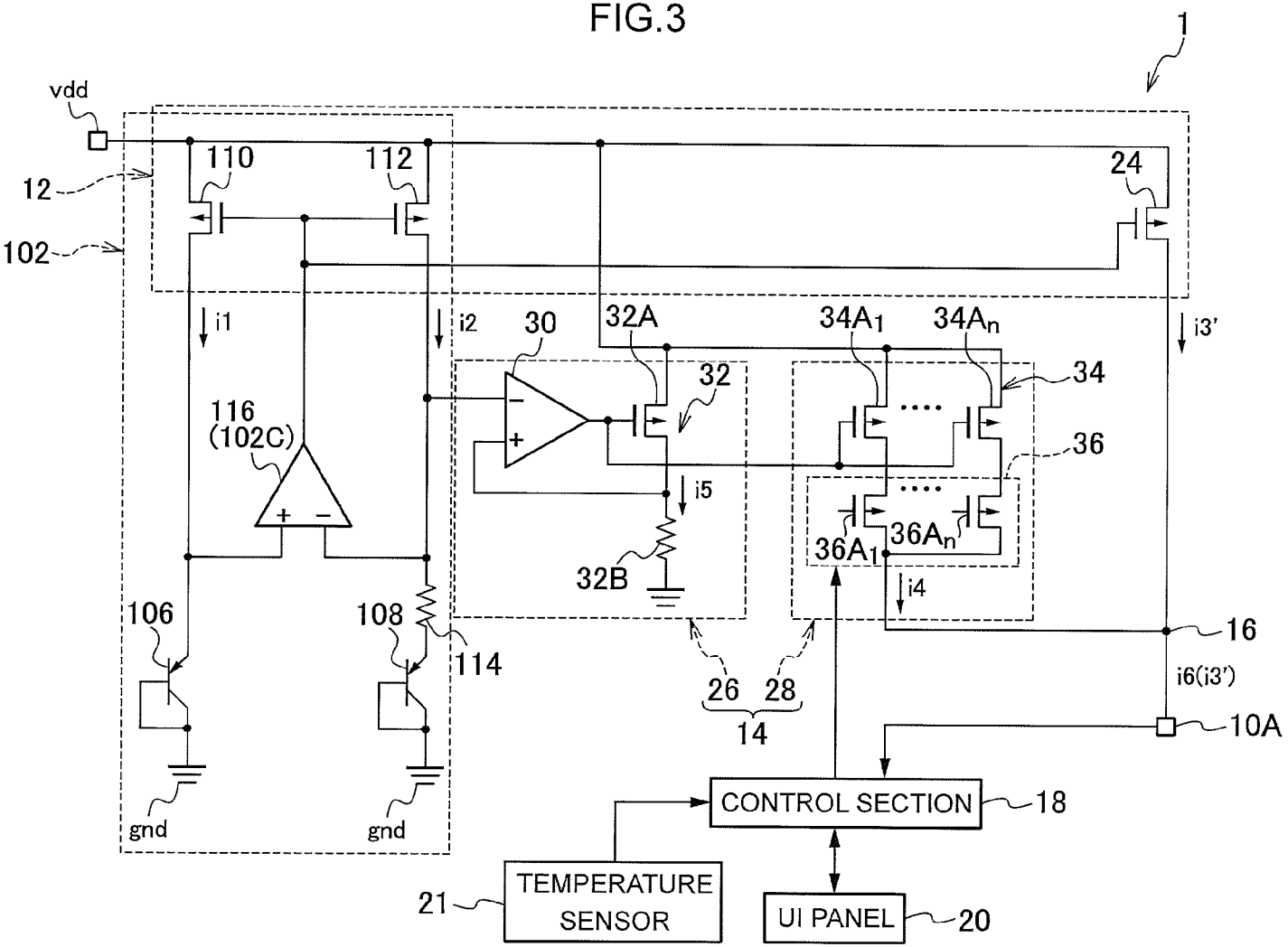
FIG. 3 is a diagram illustrating a configuration of the PTAT current output device according to the first exemplary embodiment.

Next, a circuit configuration of the current output device 1 is described with reference to FIG. 3. Note that FIG. 3 is a structural diagram showing an example configuration of the current output device 1 according to the first exemplary embodiment of the present invention. As illustrated in FIG. 3, the current output device 1 includes the reference voltage generation circuit 102, the reference current generation circuit 12, the conversion and output circuit 14, the superimposition and output section 16, a control section 18, a user interface (UI) panel 20, a temperature sensor 21, and an output terminal 10A.

The reference voltage generation circuit 102 includes the pnp-type bipolar transistors (hereinafter referred to simply as bipolar transistors) 106 and 108, the PMOS transistors 110 and 112, the resistor 114 and the operational amplifier 116. The ratio of the size of the bipolar transistor 106 to the size of the bipolar transistor 108 (the transistor ratio) is set as (size of the bipolar transistor 106):(size of the bipolar transistor 108) =1:N (a value greater than 1).

The source terminals of the PMOS transistors 110 and 112 are connected to a voltage line vdd to which a DC voltage for driving is applied, in order to drive the current output device 1. The drain terminal of the PMOS transistor 110 is connected to the emitter terminal of the bipolar transistor 106, and to the non-inverting input terminal of the operational amplifier 116. The drain terminal of the PMOS transistor 112 is connected to one end of the resistor 114, and to the inverting input terminal of the operational amplifier 116. The other end of the resistor 114 is connected to the emitter terminal of the bipolar transistor 108. The output terminal of the operational amplifier 116 is connected to the gate terminals of the PMOS transistors 110 and 112. The collector terminal of the bipolar transistor 106 is connected to ground, and the base terminal of the bipolar transistor 106 is connected to the collector terminal thereof. Further, the collector terminal of the bipolar transistor 108 is connected to ground, and the base terminal of the bipolar transistor 108 is connected to the collector terminal thereof.

The reference current generation circuit 12 includes a portion of the reference voltage generation circuit 102 and a PMOS transistor 24 and a current mirror circuit is configured by the portion of the reference voltage generation circuit 102 and the PMOS transistor 24. Namely, this current mirror circuit is configured by the source terminal of the PMOS transistor 24 being connected to the voltage line vdd, the gate terminal of the PMOS transistor 24 being connected to the output terminal of the operational amplifier 116, which serves as the current supply source 102C, and the drain terminal of the PMOS transistor 24 being connected to the output terminal 10A via the superimposition and output section 16. Therefore, the PMOS transistor 24 may convert a current corresponding to the current i1 (=i2) to a current that corresponds to the current mirror ratio (a reference current i3'), and may output the converted current.

The conversion and output circuit 14 includes a voltage-current conversion section 26, and an adjustment current output section 28. The voltage-current conversion section 26 converts the reference voltage, outputted from the reference voltage generation circuit 102, to a current, and outputs the converted current. The voltage-current conversion section 26 includes an operational amplifier 30 and a series circuit 32. The series circuit 32 includes a PMOS transistor 32A and a resistor 32B. The source terminal of the PMOS transistor 32A is connected to the voltage line vdd. One end of the resistor 32B is connected to the drain terminal of the PMOS transistor 32A, and the non-inverting input terminal of the operational amplifier 30. The other end of the resistor 32B is connected to ground.

The inverting input terminal of the operational amplifier 30 is connected to wiring of the reference voltage generation circuit 102 (in the first exemplary embodiment of the present invention, wiring that is connected to the PMOS transistor 112, the resistor 114 and the inverting input terminal of the operational amplifier 116). The output terminal of the operational amplifier 30 is connected to the gate terminal of the PMOS transistor 32A.

The adjustment current output section 28 includes a transistor unit 34 and a switching section 36. The transistor unit 34 outputs an adjustment current i4 for adjusting the reference current i3', that is outputted from the reference voltage and current generation circuit 12. The transistor unit 34 includes PMOS transistors 34$A_1$ to 34$A_n$ having different sizes, and are connected in parallel. The source terminal of each of the PMOS transistors 34$A_1$ to 34$A_n$ is connected to the voltage line vdd. Note that the respective sizes of the PMOS transistors 34$A_1$ to 34$A_n$, according to the first exemplary embodiment of the present invention, are determined by keeping the gate lengths fixed and varying the gate widths. The sizes are designed so as to increase in steps of a predetermined ratio from the PMOS transistor 34$A_1$ to the PMOS transistor 34$A_n$ (for example, in accordance with a predetermined geometric progression such as powers of 2, powers of 3 or the like). When the sizes increase in accordance with a predetermined geometric progression, current values of the adjustment current i4, the superimposition current, and the like, that are outputted may be easily estimated.

The transistor unit 34 is connected to the voltage-current conversion section 26. Specifically, the respective gate terminals of the PMOS transistors 34$A_1$ to 34$A_n$ are connected to the output terminal of the operational amplifier 30 of the voltage-current conversion section 26. Thus, a current mirror circuit is configured by the voltage-current conversion section 26 and the PMOS transistors 34$A_1$ to 34$A_n$. Hence, the respective PMOS transistors 34$A_1$ to 34$A_n$ convert a current i5 that flows through the series circuit 32 of the voltage-current conversion section 26 to the adjustment current i4, which is a current in that corresponds to the current mirror ratio, and output the adjustment current i4. When the resistance of the resistor 32B is denoted by R and the voltage applied to the inverting input terminal of the operational amplifier 30 is denoted by $V_{BG}$, the current value of the current i5 may be represented by $V_{BG}/R$.

The output of the operational amplifier 30 is determined on the basis of the reference voltage generated by the reference voltage generation circuit 102. Therefore, the characteristics of the respective currents outputted from the PMOS transistors 34$A_1$ to 34$A_n$ are dependent on the characteristics of the reference voltage generated by the reference voltage generation circuit 102. Accordingly, the characteristics of the respective currents outputted from the PMOS transistors 34$A_1$ to 34$A_n$ may be changed by changing the characteristics of the structural components of the reference voltage generation circuit 102 (for example, changing the transistor ratio of the bipolar transistors 106 and 108) and changing the characteristics of the reference voltage.

The switching section 36 is for switching to use the current(s) outputted from any of the PMOS transistors 34$A_1$ to 34$A_n$ as the adjustment current i4, includes PMOS transistors 36$A_1$ to 36$A_n$ Hereinafter, in the descriptions, when it is not necessary to distinguish between the PMOS transistors 34$A_1$ to 34$A_n$ simply "the PMOS transistors 34A" are referred to, and when it is not necessary to distinguish between the PMOS transistors 36$A_1$ to 36$A_n$ simply "the PMOS transistors 36A" are referred to.

The respective source terminals of the PMOS transistors 36$A_1$ to 36$A_n$ are connected to the drain terminals of the corresponding PMOS transistors 34A of the PMOS transistors 34$A_1$ to 34$A_n$. Namely, the source terminal of the PMOS transistor 36$A_1$ is connected to the drain terminal of the PMOS transistor 34$A_1$, . . . and the source terminal of the PMOS transistor 36An is connected to the drain terminal of the PMOS transistor 34$A_n$. Further, the drain terminals of the PMOS transistors 36$A_1$ to 36$A_n$ are connected to the superimposition and output section 16.

Therefore, currents outputted from the PMOS transistors 34$A_1$ to 34$A_n$ are outputted from the adjustment current output section 28 as the adjustment current i4 by the PMOS transistors 36$A_1$ to 36$A_n$ being switched on (on-voltages, which are voltages whose absolute values exceed absolute values of threshold voltages, being applied to the gate terminals). That is, when a plural number of the PMOS transistors 36A are switched on, a current obtained by superimposing the currents outputted from the respective PMOS transistors 34A that correspond to these PMOS transistors 36A, is outputted from the adjustment current output section 28 as the adjustment current i4. Further, when a single PMOS transistor 36A is switched on, the current outputted from the PMOS transistor 34A that corresponds to this PMOS transistor 36A is outputted from the adjustment current output section 28, as the adjustment current i4.

The superimposition and output section 16 is a section that connects the adjustment current output section 28 to the drain terminal of the PMOS transistor 24 of the reference current generation circuit 12, and is connected to the output terminal 10A of the current output device 1. Accordingly, a superimposed current i6, which is a current obtained by superimposing the adjustment current i4 outputted from the adjustment current output section 28 with the reference current i3 outputted from the drain terminal of the PMOS transistor 24, is outputted through the output terminal 10A. When none of the PMOS transistors 36$A_1$ to 36$A_n$ are switched on, the reference current i3' is outputted through the output terminal 10A.

The control section 18 is a computer including a central processing unit (CPU), a read-only memory (ROM), a random access memory (RAM), a hard disc drive and so forth. The CPU performs overall control of the current output device 1 by executing processing of predetermined programs. The ROM is a memory medium in which a control program that controls operations of the current output device 1 and a reference voltage adjustment process program, which is described below, are pre-memorized. The RAM is a memory medium that is used as a work area during execution of the various programs and the like. In the ROM, a table is pre-memorized in which transistor characteristic information and an amount (current value) of the adjustment current i4 outputted from the adjustment current output section 28 are associated. The transistor characteristic information represents the PMOS transistors 36A that correspond to the PMOS transistors 34A (the PMOS transistors 36A that are connected in series with the PMOS transistors 34A) among the PMOS transistors 34$A_1$ to 34$A_n$ that are to be used for output as the adjustment current. The adjustment current i4 of each amount is outputted from the adjustment current output section 28 by switching on the PMOS transistors 36A represented by the associated transistor characteristic information.

The user interface panel 20 is configured with, for example, a touch panel display in which a transparent touch panel is overlaid on a display, or the like. The user interface panel 20 displays different kinds of information on a display screen of the display, and receives inputs of required information, instructions and the like by a user touching the touch panel. The user interface panel 20 is suitably provided or not as required, but it is preferable in regard to operability if the user interface panel 20 is provided.

The temperature sensor 21 detects the absolute temperature at a predetermined location of the current output device 1 (for example, a vicinity of the PMOS transistor 24).

The control section 18 is connected to the output terminal 10A, the user interface panel 20, the temperature sensor 21 and the switching section 36. Accordingly, the control section 18 may acquire the amount of currents outputted from the output terminal 10A, may acquire absolute temperatures detected by the temperature sensor 21, may display various kinds of information at the user interface panel 20 and acquire details of operational instructions from a user at the user interface panel 20, and may control the switching section 36 (control switching operations of the PMOS transistors 36$A_1$ to 36$A_n$) in response to operational instructions from the user that are inputted via the user interface panel 20.

Next, operation of the current output device 1 is described.

Figure 4:
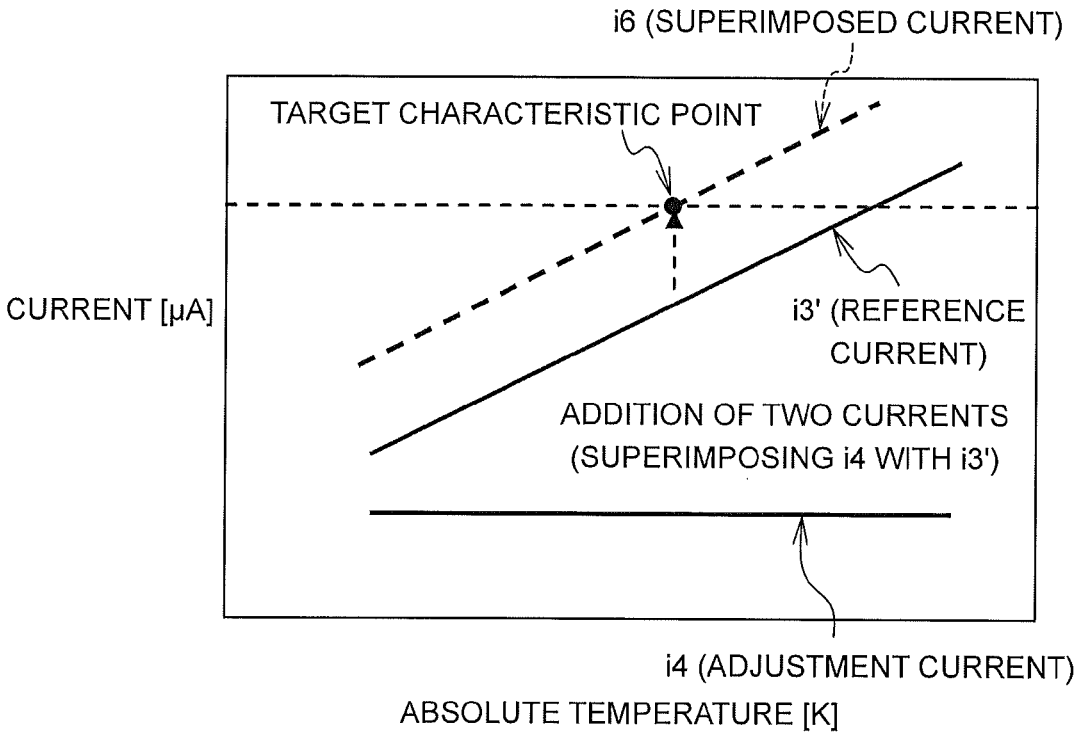
FIG. 4 is a graph illustrating an absolute temperature characteristics of a reference current, an adjustment current and a superimposed current, generated by the PTAT current output device according to the first exemplary embodiment.

When a driving voltage is applied to the voltage line vdd when none of the PMOS transistors 36$A_1$ to 36$A_n$ are switched on (the PMOS transistors 36$A_1$ to 36$A_n$ are turned off), the reference current i3', for example, as illustrated in FIG. 4, is outputted from the drain terminal of the transistor unit 34 in response.

Hence, when, for example, the current value of the reference current i3' falls below a required current value as illustrated in FIG. 4, because of fabrication irregularities of the PMOS transistor 24 and/or the other elements of the current output device 1 or suchlike, reference current adjustment process may be executed in order to adjust the current value of the reference current i3' to the predetermined current value, without changing the temperature gradient.

Figure 5:
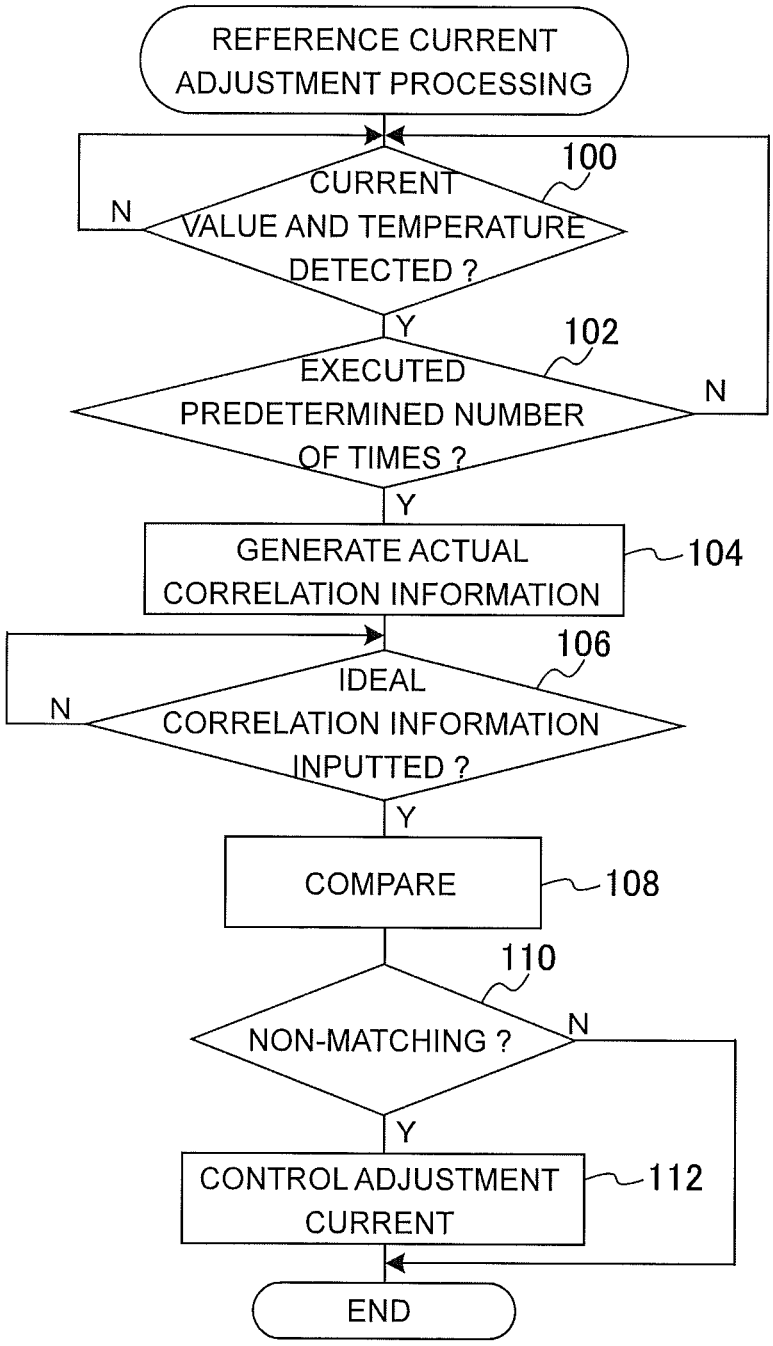
FIG. 5 is a flowchart illustrating the process of a reference current adjustment processing program according to the first exemplary embodiment.

Next, referring to FIG. 5, operation of the current output device 1 when the reference current adjustment process is being executed is described. FIG. 5 is a flowchart illustrating the flow of process of the reference current adjustment process program that is executed by the control section 18 of the current output device 1, when an instruction for execution of the reference current adjustment process is inputted via the user interface panel 20. This program is pre-memorized in a predetermined region of the ROM.

In step 100 of FIG. 5, the control section 18 waits until a current value of the reference current i3' outputted from the output terminal 10A and an absolute temperature detected by the temperature sensor 21 are detected. Then the control section 18 proceeds to step 102 and determines whether the process of step 100 has been executed a predetermined number of times (for example, five times). If a negative determination has been made, the control section 18 returns to step 100, and if an affirmative determination has been made, the control section 18 proceeds to step 104.

In step 104, actual correlation information (for example, information representing a graph including an actual temperature gradient (for example, the graph of reference current i3' shown in FIG. 4)) is generated using the results detected by the processing of step 100. The actual correlation information represents a correlation (an actual temperature gradient) between the current values of the reference current i3' outputted from the output terminal 10A and the absolute temperatures detected by the temperature sensor 21.

Then, in step 106, the control section 18 waits for an input of ideal correlation information representing an ideal correlation (an ideal temperature gradient) between absolute temperatures and current values that is required for the reference current i3' (for example, information representing a graph of the ideal temperature gradient (as an example, the graph of i6 shown in FIG. 4)). Then the control section 18 proceeds to step 108, and compares the actual correlation information generated by the processing of step 104 with the ideal correlation information inputted by the processing of step 106. Then, in step 110, the control section 18 determines from the result of the comparison by the processing of step 108 whether or not the actual correlation information and the ideal correlation information match to within a predetermined error range (for example, ±0.1%). If a negative determination is made, the current reference current adjustment process program ends. If an affirmative determination is made, the control section 18 proceeds to step 112, and controls the adjustment current output section 28 such that an adjustment current i4 needed to make the actual correlation information and the ideal correlation information match to within the predetermined error range is outputted from the adjustment current output section 28. Thereafter, the current reference current adjustment process program ends.

In step 112, the control section 18 refers to the table memorized in the ROM and specifies the PMOS transistors 36A, that must be put into a state of conduction between the source terminal and the drain terminal, such that the adjustment current i4 outputted from the adjustment current output section 28 (the current whose characteristics do not change with temperature variations) and superimposed on the reference current i3' makes the actual correlation information and the ideal correlation information match to within the predetermined error range. The control section 18 controls the adjustment current output section 28 by applying the ON voltages to the gate terminals of the specified PMOS transistors 36A. Accordingly, at the superimposition and output section 16, the adjustment current i4 outputted from the adjustment current output section 28 and the reference current i3' outputted from the PMOS transistor 24 of the reference current generation circuit 12 are superimposed and outputted through the output terminal 10A as the superimposed current i6.

Thus, according to the current output device 1 according to the first exemplary embodiment of the present invention, when, for example, a temperature range for which use of a wireless transmission device is to be guaranteed is set from −20° C. to +80° C., superimposed currents i6 may be obtained with the same temperature gradient over the temperature range from −20° C. to +80° C.

As is described in detail above, in the current output device 1 according to the first exemplary embodiment of the present invention, the reference current i3' is outputted by the reference current generation circuit 12, the reference voltage outputted from the reference voltage generation circuit 102 is converted to the adjustment current i4 by the conversion and output circuit 14 and outputted, and the reference current i3' and the adjustment current i4 are superimposed by the superimposition and output section 16 and the superimposed current i6 is outputted. Thus, the amount of the reference current i3' may be adjusted while maintaining the temperature gradient (which is a positive temperature gradient in the first exemplary embodiment of the present invention).

Moreover, in the current output device 1 according to the first exemplary embodiment of the present invention, because the adjustment current i4 is outputted by the PMOS transistors 34$A_1$ to 34$A_n$ having different sizes that are connected in parallel, and being selectively used by the conversion and output circuit 14, the superimposed current i6 may be adjusted simply and accurately.

In the current output device 1 according to the first exemplary embodiment of the present invention, the table of associative information that associates the transistor characteristic information, which represents the PMOS transistors 36A that are connected in series with the PMOS transistors 34A as characteristic information specifying the PMOS transistors 34A of the PMOS transistors 34$A_1$ to 34$A_n$ to be used for outputting the adjustment current i4, with the amount of the adjustment current i4 that are outputted from the adjustment current output section 28 when the PMOS transistors 36A represented by this transistor characteristic information are turned on, is pre-memorized in the ROM serving as a memory section. Ideal correlation information including adjustment current information representing an ideal adjustment current i4 amount is received by the user interface panel 20. By switching on the PMOS transistors 36A that are represented by the transistor characteristic information associated with the ideal adjustment current i4 amount represented by the adjustment current information included in the ideal correlation information that has been received by the user interface panel 20, the conversion and output circuit 14 outputs the currents that are outputted from the PMOS transistors 34A associated with these PMOS transistors 36A as the adjustment current i4. Thus, the adjustment current i4 may be finely adjusted simply and accurately.

In the current output device 1 according to the first exemplary embodiment of the present invention, the plural PMOS transistors 36A that are usually in non-conducting states are included between the transistor unit 34 and the superimposition and output section 16, and are connected in respective series with the PMOS transistors 34A. The adjustment current i4 is outputted from the adjustment current output section 28 by, of the PMOS transistors 36A, the PMOS transistors 36A that are represented by the transistor characteristic information associated with the ideal adjustment current i4 amount, which is represented by the adjustment current information included in the ideal correlation information received by the user interface panel 20, being switched on. Thus, the adjustment current i4 may be finely adjusted even more simply and accurately.

In the first exemplary embodiment of the present invention, a PTAT current output device 1 is described as an example, and the present invention is not limited thereto. Any current output circuit that outputs a reference current i3' having a positive temperature gradient, may be applied.

In the first exemplary embodiment of the present invention, the reference voltage generation circuit 102 that generates a band gap voltage is described as an example, and the present invention is not limited thereto. Any reference voltage generation circuit that may supply a current having a positive temperature gradient to the reference current generation circuit 12 and a reference voltage to the conversion and output circuit 14 may be used.

Second Exemplary Embodiment

In the first exemplary embodiment described above, an embodiment is described in which a current having a positive temperature gradient is fed out as the reference current. In a second exemplary embodiment of the present invention, an example in which a current having a negative temperature gradient is fed out as a reference current, is described. In the second exemplary embodiment of the present invention, configurations that are the same as in the first exemplary embodiment are assigned the same reference numerals, and description thereof is omitted.

Figure 6:
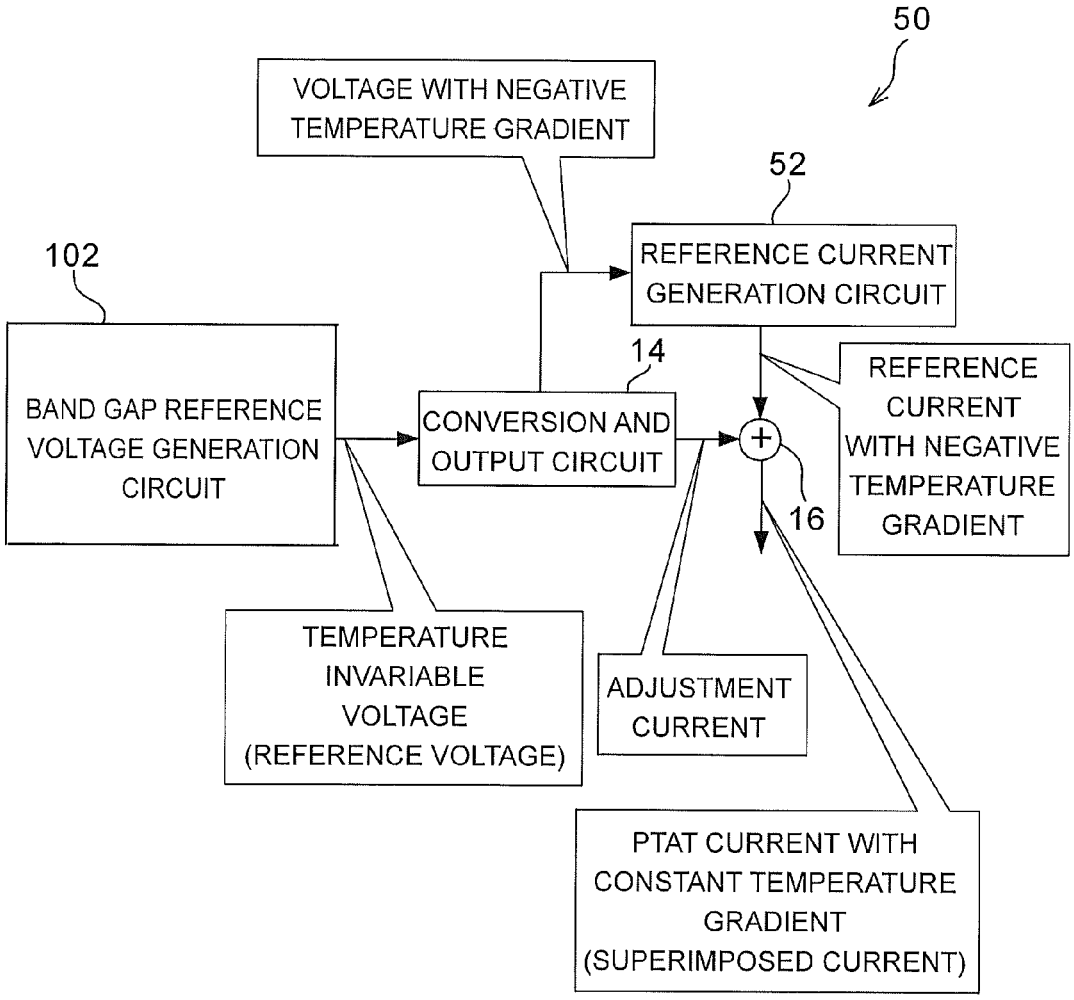
FIG. 6 is a block diagram illustrating a substantial configuration of a PTAT current output device according to a second exemplary embodiment.

FIG. 6 is a block diagram illustrating a substantial configuration of a current output device 50 according to the second exemplary embodiment of the present invention. As illustrated in FIG. 6, the current output device 50 differs from the current output device 1 according to the above-described first exemplary embodiment, in which a reference current generation circuit 52 is employed instead of the reference current generation circuit 12, the superimposition and output section 16 is connected to the reference current generation circuit 52, and the reference current generation circuit 52 instead of the reference current generation circuit 12 is connected to the superimposition and output section 16. Note that the current output device 50 is merely an example. Obviously, current output devices that may obtain the same effects with other circuit elements and connection states from the current output device 50, are possible. In FIG. 6, the control section 18, the user interface panel 20 and the temperature sensor 21 are omitted from the drawing.

The reference current generation circuit 52 generates and outputs a reference current having a negative temperature gradient. More specifically, the reference current generation circuit 52 obtains a voltage applied to the gate terminal of the PMOS transistor 32A by a current mirror circuit (a third current mirror circuit), uses this voltage to generate a voltage having a negative temperature gradient, converts the generated voltage to a current, and feeds out the converted current by a current mirror circuit (a fourth current mirror circuit).

Figure 7:
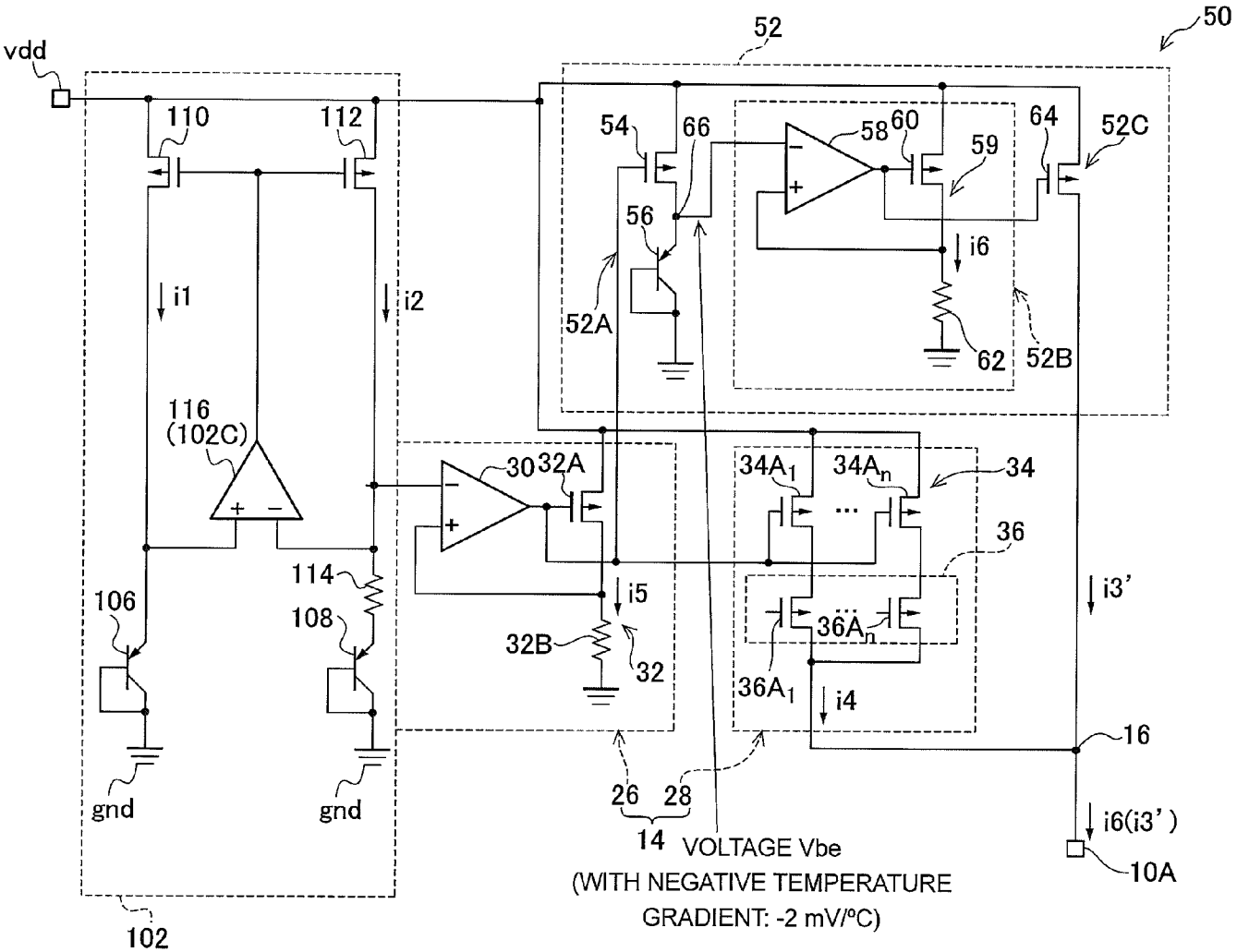
FIG. 7 is a diagram illustrating a configuration of the PTAT current output device according to the second exemplary embodiment.

Next, a circuit configuration of the current output device 50 is described with reference to FIG. 7. FIG. 7 is a diagram showing an example configuration of the current output device 50 according to the second exemplary embodiment of the present invention. As illustrated in FIG. 7, the reference current generation circuit 52 includes a negative voltage generation circuit 52A, a voltage-current conversion circuit 52B and an output section 52C.

The negative voltage generation circuit 52A generates and outputs a voltage having a negative constant temperature gradient. The negative voltage generation circuit 52A includes a PMOS transistor 54 and a bipolar transistor 56.

The collector terminal of the bipolar transistor 56 is connected to ground, and the base terminal of the bipolar transistor 56 is connected to the collector terminal thereof.

The gate terminal of the PMOS transistor 54 is connected to the output terminal of the operational amplifier 30. The source terminal of the PMOS transistor 54 is connected to the voltage line vdd, and the drain terminal of the PMOS transistor 54 is connected to the emitter terminal of the bipolar transistor 56. Accordingly, a current mirror circuit (the third current mirror circuit) is configured by the voltage-current conversion section 26 and the PMOS transistor 54. Therefore, the PMOS transistor 54 converts a current i5 flowing in the series circuit 32 of the voltage-current conversion section 26 to a current that corresponds to the current mirror ratio and outputs the converted current. A voltage $V_{be}$ having a negative constant temperature gradient (for example, −2 mV/° C.) is generated at a connection point 66 between the PMOS transistor 54 and the bipolar transistor 56, by the current outputted by the PMOS transistor 54 counterbalancing the current having the negative temperature gradient from the bipolar transistor 56.

The voltage-current conversion circuit 52B converts the voltage $V_{be}$ outputted from the negative voltage generation circuit 52A to a current, and outputs the current. The voltage-current conversion circuit 52B includes an operational amplifier 58 and a series circuit 59. The series circuit 59 includes a PMOS transistor 60 and a resistor 62. The source terminal of the PMOS transistor 60 is connected to the voltage line vdd. One end of the resistor 62 is connected to the drain terminal of the PMOS transistor 60 and the non-inverting terminal of the operational amplifier 58. The other end of the resistor 62 is connected to ground. The non-inverting terminal of the operational amplifier 58 is connected to the connection point 66 of the negative voltage generation circuit 52A. The output terminal of the operational amplifier 58 is connected to the gate terminal of the PMOS transistor 60. If the resistance of the resistor 62 is denoted by R', the current value of a current i6 may be represented by $V_{be}/R'$.

The output section 52C includes a PMOS transistor 64. The source terminal of the PMOS transistor 64 is connected to the voltage line vdd, and the drain terminal of the PMOS transistor 64 is connected to the superimposition and output section 16. Namely, in the reference current generation circuit 52, a current mirror circuit (the fourth current mirror circuit) is configured by the voltage-current conversion circuit 52B and the PMOS transistor 64 of the output section 52C. Therefore, a current having a negative temperature gradient is obtained by the voltage $V_{be}$ being converted by the voltage-current conversion circuit 52B, and the PMOS transistor 64 may convert the converted current to a current that corresponds to the current mirror ratio (the reference current i3' having a negative temperature gradient) and output the same.

Figure 8:
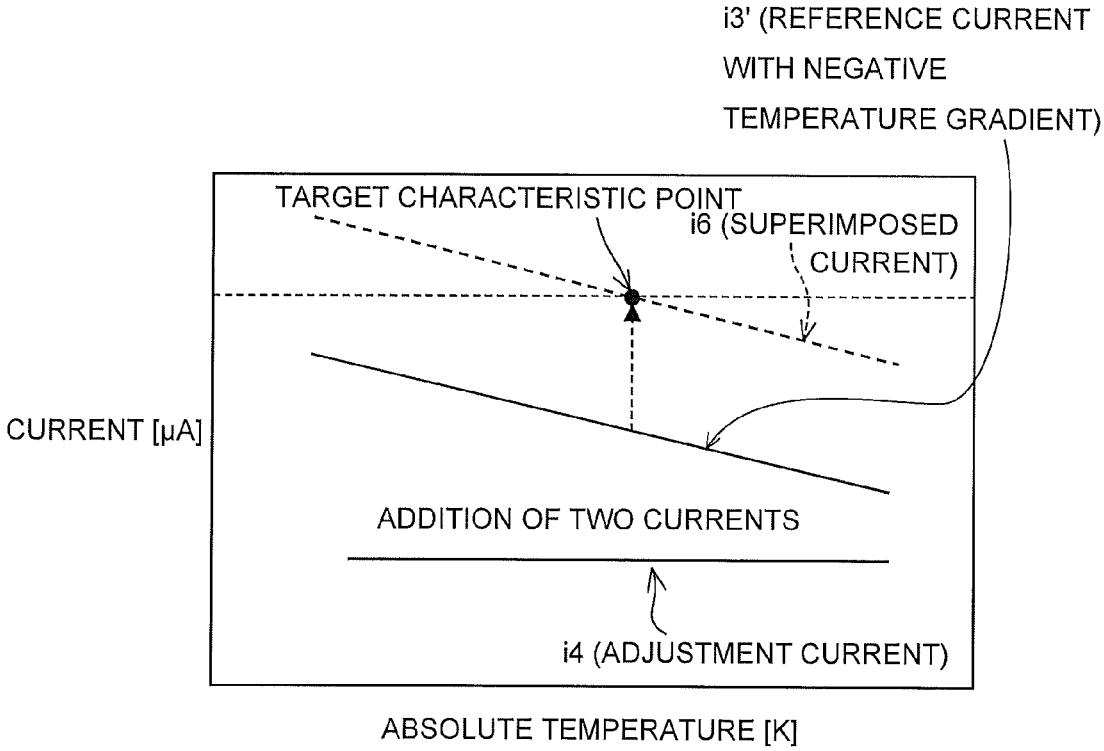
FIG. 8 is a graph illustrating an absolute temperature characteristics of a reference current, an adjustment current and a superimposed current, generated by the PTAT current output device according to the second exemplary embodiment.

According to the current output device 50 with this configuration, at the superimposition and output section 16, the adjustment current i4 outputted from the adjustment current output section 28 is superimposed with the reference current i3' having a negative temperature gradient outputted from the PMOS transistor 64 of the reference current generation circuit 52, and is outputted from the output terminal 10A as a superimposed current i6, for example, as illustrated in FIG. 8. Therefore, the amount of the reference current i3' may be adjusted while maintaining the temperature gradient (a negative temperature gradient in the second exemplary embodiment of the present invention).

Figure 9:
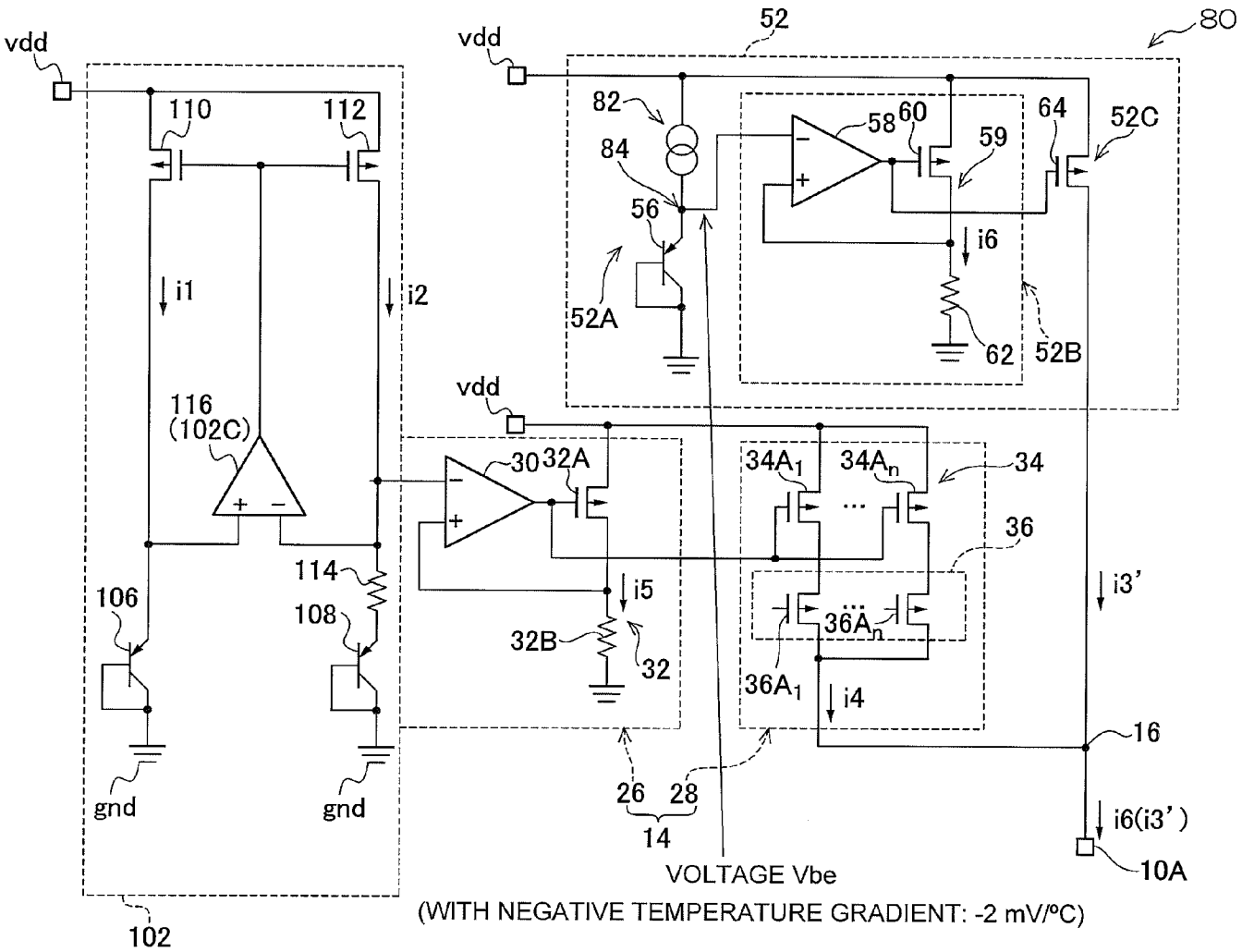
FIG. 9 is a diagram illustrating a configuration of a PTAT current output device of an alternative example of the PTAT current output device according to the second exemplary embodiment.
Figure 10:
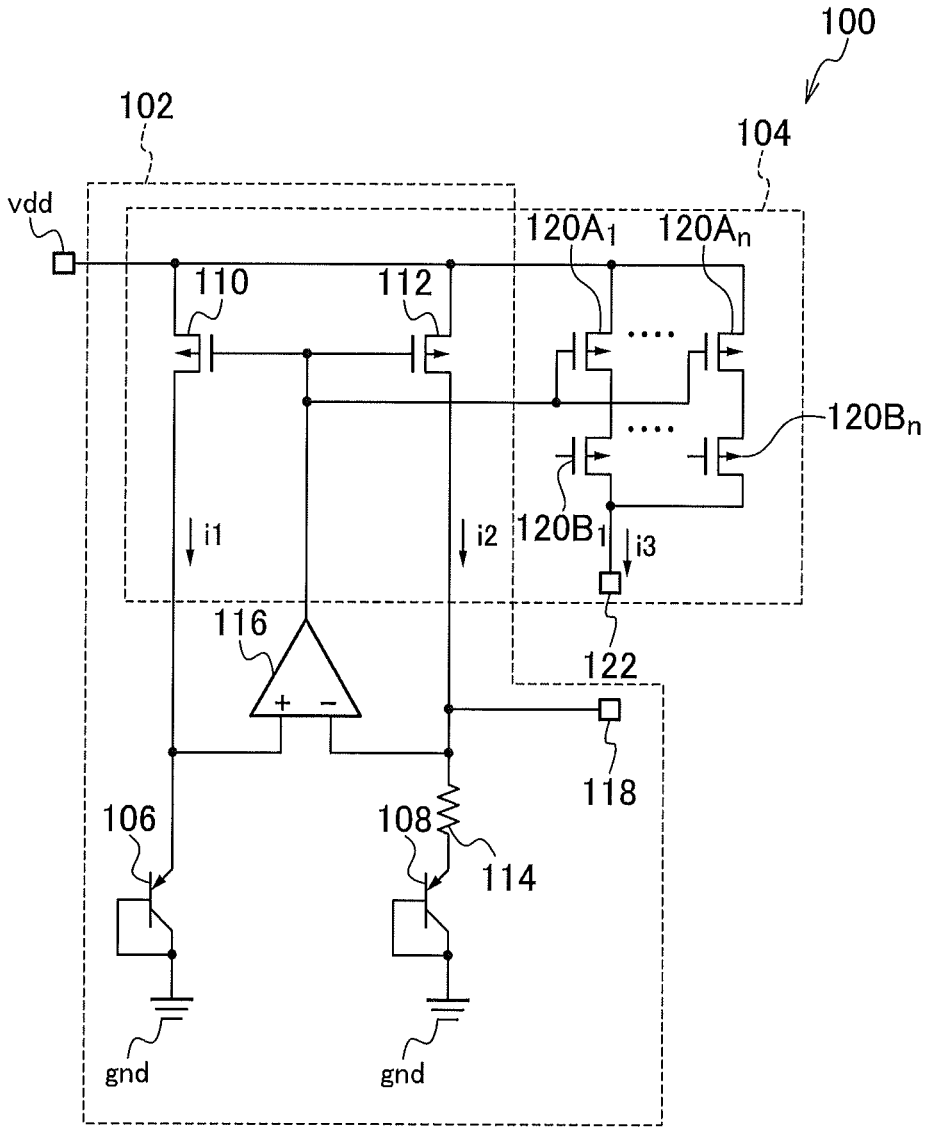
FIG. 10 is a circuit diagram illustrating a circuit configuration of a conventional PTAT current output device.
Figure 11:
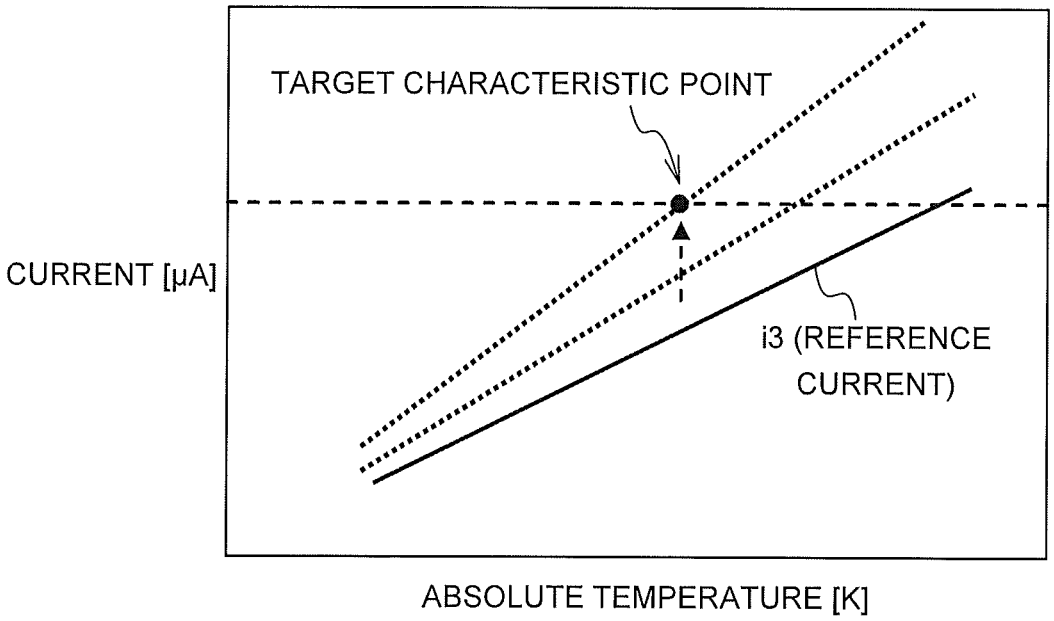
FIG. 11 is a graph illustrating absolute temperature characteristics before and after adjustment of a reference current, generated by the conventional PTAT current output device.

In the above-described second exemplary embodiment, an example in which a voltage having a negative temperature gradient is generated using the PMOS transistor 54 has been described. However, a constant current source may be employed instead of the PMOS transistor 54. FIG. 9 is a structural diagram showing an example of configuration of a PTAT current output device 80 which is an alternative example of the current output device 50 according to the second exemplary embodiment described above. As illustrated in FIG. 9, the PTAT current output device 80 differs from the current output device 50, according to the above second exemplary embodiment, only in that a constant current source 82 is employed instead of the PMOS transistor 54 and a connection point 84 is employed between the constant current source 82 and the bipolar transistor 56 instead of the connection point 66. Thus, in the PTAT current output device 80, the voltage $V_{be}$ is generated in a similar manner to the current output device 50 according to the above second exemplary embodiment. Therefore, the effect that the amount of the reference current i3' may be adjusted while maintaining the negative temperature gradient is provided. However, if an increase in costs and an increase in size of the device should be restrained while obtaining this effect, the configuration of the current output device 50 according to the above second exemplary embodiment is preferable.

In the second exemplary embodiment described above, the reference voltage generation circuit 102 that generates a band gap voltage has been described as an example, however, the present invention is not limited thereto. The present invention is applicable with any reference voltage generation circuit that may supply a current having a positive temperature gradient to the reference current generation circuit 12 and that may supply a reference voltage to the conversion and output circuit 14.

In the above first exemplary embodiment, an example is given in which the superimposed current i6 having a positive temperature gradient is obtained, and in the above second exemplary embodiment, an example is given in which the superimposed current i6 having a negative temperature gradient is obtained. However, the present invention is not limited thereto. Obviously, a superimposed current i6 having a temperature gradient of zero may be obtained by employing the present invention.

In the exemplary embodiments described above, examples are described in which the switching section 36 of the adjustment current output section 28 is controlled by the control section 18. However, the on-voltages may be applied to gate terminals of the PMOS transistors 36A that are to be put into conducting states between the source terminals and drain terminals, to make the actual correlation information match the ideal correlation information to within the predetermined error range, without going through the control section 18.

In the above exemplary embodiments, examples are described in which the transistor unit 34 that includes the plural PMOS transistors 34A is employed. However, if the characteristics of the reference current i3' to be outputted by the reference current generation circuit 12 may be ascertained in advance, a single PMOS transistor may be employed instead of the transistor unit 34. In this configuration, because the current outputted from the PMOS transistor is used as the adjustment current i4, characteristics of the outputted current must be ascertained beforehand. If the single PMOS transistor is employed instead of the transistor unit 34 in this manner, the control section 18, the user interface panel 20, the temperature sensor 21 and the switching section 36 are unnecessary, and the number of components may be reduced.

In the above exemplary embodiments, examples are described in which the reference voltage generation circuit 102 that includes the bipolar transistors 106 and 108 is employed. However, the present invention is not limited thereto. For example, diode-connected transistors may be employed instead of bipolar transistors. Thus, any band gap reference voltage generation circuit may be used if it generates a reference voltage (a constant voltage) similar to the reference voltage generation circuit 102.

In the above exemplary embodiments, examples are described in which the sizes of the PMOS transistors 34$A_1$ to 34$A_n$ are designed to increase in predetermined ratio steps. However, the present invention is not limited thereto. The sizes of the PMOS transistors 34$A_1$ to 34$A_n$ may be determined in accordance with fine adjustment amounts of current values that are required.

In the above exemplary embodiments, examples are described in which the mode for carrying out the functions of the control section 18 is a software mode. However, the present invention is not limited thereto. A hardware mode in which various circuits are connected (for example, an application-specific integrated circuit (ASIC)), a mode in which a hardware mode and a software mode are combined, and the like, may be given as examples.

What is claimed is:

1. A reference current output device comprising:

a reference voltage generation section that generates a reference voltage that does not change dependent on changes in temperature;

a reference current output section that outputs a reference current having a predetermined temperature gradient;

a conversion and output section that converts the reference voltage to a current and uses a current mirror circuit to output the current as an adjustment current, the conversion and output section including a plurality of transistors having different sizes that are connected in parallel and that configure the current mirror circuit, and a switching section for selecting the plurality of transistors;

a temperature sensor that detects an absolute temperature at a predetermined location of the reference current output device;

a control section, connected to the switching section, that controls the switching section based on the absolute temperature detected by the temperature sensor; and a superimposition and output section that superimposes the reference current with the adjustment current, and outputs the superimposed current.

2. The reference current output device according to claim 1, wherein the reference voltage generation section generates the reference voltage by counteracting a current having a positive temperature gradient and a current having a negative temperature gradient.

3. The reference current output device according to claim 1, wherein the reference current output section uses the reference voltage generation section to output a reference current having a positive temperature gradient as the predetermined temperature gradient.

4. The reference current output device according to claim 1, wherein the predetermined temperature gradient is a positive temperature gradient, and the reference current output section uses a second current mirror circuit to output, as the reference current, a current having a positive constant temperature gradient that flows at the reference voltage generation section in order for the reference voltage generation section to generate the reference voltage.

5. The reference current output device according to claim 4, wherein the second current mirror circuit includes a PMOS transistor that outputs the reference current as a current that corresponds to a current mirror ratio with respect to the current having the positive constant temperature gradient.

6. The reference current output device according to claim 1, wherein the reference voltage generation section includes a band gap circuit that generates the reference voltage, and a characteristic of the adjustment current outputted by the conversion and output section depends on a characteristic of the reference voltage generated by the band gap circuit.

7. The reference current output device according to claim 1, wherein the control section selects the plurality of transistors having different sizes that are connected in parallel to output the adjustment current by using the switching section.

8. The reference current output device according to claim 7, wherein the control section includes:

a memory section in which association information is pre-memorized, the association information associating characteristic information, that specifies a transistor among the plurality of transistors used for outputting the adjustment current, with adjustment current information, that represents an amount of the adjustment current outputted from the conversion and output section when the specified transistor is used; and a receiving section that receives the adjustment current information, wherein the control section selects the transistor associated with the received adjustment current information.

9. The reference current output device according to claim 8, wherein the switching section includes a plurality of switching elements, provided between the plurality of transistors and the superimposition and output section, that are each connected in series with a respective transistor of the plurality of transistors, and that are usually in non-conducting states, and wherein the switching section switches, out of the plurality of switching elements, the switching element that corresponds to the transistor associated with the received adjustment current information into a conducting state.

10. The reference current output device according to claim 7, wherein each of the plurality of transistors is a PMOS transistor including a source electrode applied with a driving voltage for driving the reference voltage and current output section, a drain terminal connected to the superimposition and output section, and a gate terminal, and the second current mirror circuit includes:

the plurality of transistors;

a series circuit including a PMOS transistor, to whose source terminal is applied with the driving voltage, and a resistor having one end connected to the drain terminal of the PMOS transistor and having an other end connected to ground; and an amplification section including a non-inverting input terminal connected to the one end of the resistor, an inverting input terminal connected to a terminal of the reference voltage and current output section at which the reference voltage is outputted, and an output terminal connected to the gate terminal of the PMOS transistor of the series circuit and is connected to the gate terminals of the plurality of transistors.

11. A reference current output device comprising:

a reference voltage generation section that generates a reference voltage that does not change dependent on changes in temperature;

a reference current output section that outputs a reference current having a predetermined temperature gradient;

a conversion and output section that converts the reference voltage to a current and uses a current mirror circuit to output the current as an adjustment current; and a superimposition and output section that superimposes the reference current with the adjustment current, and outputs the superimposed current, wherein the predetermined temperature gradient is a negative temperature gradient, and wherein the reference current output section obtains a voltage corresponding to the reference voltage from another current mirror circuit, uses the obtained voltage to generate a voltage having a negative constant temperature gradient, then uses a voltage-current conversion circuit to convert the voltage having the negative constant temperature gradient to a current, and uses a further current mirror circuit to output the current as the reference current.

12. The reference current output device according to claim 11, wherein the another current mirror circuit includes a PMOS transistor to whose gate terminal is applied with the voltage corresponding to the reference voltage, and the further current mirror circuit includes a PMOS transistor that outputs a current that corresponds to the current mirror ratio with respect to the inputted current.

13. The reference current output device according to claim 11, wherein the reference voltage generation section includes a band gap circuit that generates the reference voltage, and a characteristic of the adjustment current outputted by the conversion and output section depends on a characteristic of the reference voltage generated by the band gap circuit.

14. The reference current output device according to claim 11, wherein the conversion and output section selectively uses a plurality of transistors having different sizes that are connected in parallel to output the adjustment current.

15. The reference current output device according to claim 14, further comprising:

a memory section in which association information is premorized, the association information associating characteristic information, that specifies a transistor among the plurality of transistors used for outputting the adjustment current, with adjustment current information, that represents an amount of the adjustment current outputted from the conversion and output section when the specified transistor is used; and a receiving section that receives the adjustment current information, wherein the conversion and output section uses the transistor associated with the received adjustment current information to output the adjustment current.

16. The reference current output device according to claim 15, wherein the conversion and output section further includes, a plurality of switching elements, provided between the plurality of transistors and the superimposition and output section, that are each connected in series with a respective transistor of the plurality of transistors, and that are usually in non-conducting states, and wherein the adjustment current is outputted by switching, out of the plurality of switching elements, the switching element that corresponds to the transistor associated with the received adjustment current information into a conducting state.

17. The reference current output device according to claim 14, wherein each of the plurality of transistors is a PMOS transistor including a source electrode applied with a driving voltage for driving the reference voltage and current output section, a drain terminal connected to the superimposition and output section, and a gate terminal, and the second current mirror circuit includes:

the plurality of transistors;

a series circuit including a PMOS transistor, to whose source terminal is applied with the driving voltage, and a resistor having one end connected to the drain terminal of the PMOS transistor and having an other end connected to ground; and an amplification section including a non-inverting input terminal connected to the one end of the resistor, an inverting input terminal connected to a terminal of the reference voltage and current output section at which the reference voltage is outputted, and an output terminal connected to the gate terminal of the PMOS transistor of the series circuit and is connected to the gate terminals of the plurality of transistors.

18. A reference current output method comprising:

generating a reference voltage that does not change dependent on changes in temperature;

outputting a reference current having a predetermined temperature gradient;

converting the reference voltage to a current and, by using a current mirror circuit, outputting the current as an adjustment current, the current mirror circuit including a plurality of transistors having different sizes that are connected in parallel;

detecting an absolute temperature at a predetermined location;

adjusting the adjustment current by selecting the plurality of transistors based on the detected absolute temperature; and superimposing the reference current with the adjustment current.

* * * * *